US012618569B2

(12) United States Patent
Zhou et al.

(10) Patent No.: US 12,618,569 B2
(45) Date of Patent: May 5, 2026

(54) WALL-MOUNTED AIR CONDITIONING INDOOR UNIT AND AIR CONDITIONER

(71) Applicant: GD MIDEA AIR-CONDITIONING EQUIPMENT CO., LTD., Foshan (CN)

(72) Inventors: Yuanle Zhou, Foshan (CN); Shuyang Pi, Foshan (CN); Zhiyong Xu, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 657 days.

(21) Appl. No.: 17/946,527

(22) Filed: Sep. 16, 2022

(65) Prior Publication Data

US 2023/0019389 A1 Jan. 19, 2023

Related U.S. Application Data

(63) Continuation of application No. PCT/CN2020/129247, filed on Nov. 17, 2020.

(30) Foreign Application Priority Data

Mar. 30, 2020 (CN) ..... 202010241373.3

(51) Int. Cl.
*F24F 1/0011* (2019.01)
*F24F 1/0057* (2019.01)
(Continued)

(52) U.S. Cl.
CPC ..... *F24F 1/0057* (2019.02); *F24F 1/0011* (2013.01); *F24F 1/0071* (2019.02); *F24F 13/20* (2013.01)

(58) Field of Classification Search
CPC ..... F24F 1/0057; F24F 1/0071; F24F 1/0011; F24F 13/20
(Continued)

(56) References Cited

U.S. PATENT DOCUMENTS 5,730,653 A * 3/1998 Van Becelaere ..... A62C 2/14 454/369
2016/0108925 A1 4/2016 Huang et al.
(Continued)

FOREIGN PATENT DOCUMENTS

CN 201582118 U 9/2010
CN 108266800 A 7/2018
(Continued)

OTHER PUBLICATIONS

You, Junxiong, CN110657492 Translation.pdf, "Fresh air device and air-conditioner indoor unit provided with same", Jan. 2020, pp. 1-12.*
(Continued)

*Primary Examiner* — Avinash A Savani
*Assistant Examiner* — Ryan L Faulkner
(74) *Attorney, Agent, or Firm* — Scully, Scott, Murphy & Presser, P.C.

(57) ABSTRACT

Disclose are a wall-mounted air conditioning indoor unit and an air conditioner. The wall-mounted air conditioning indoor unit includes: an indoor unit body; a fresh air module including a housing, the housing being provided with a fresh air inlet, a fresh air outlet, and a fresh air duct communicating the fresh air inlet with the fresh air outlet, the fresh air inlet being configured to communicated with the outdoor environment, and the fresh air outlet being communicated with an air inlet of the indoor unit body; a wind wheel installed in the fresh air duct; and a valve installed at the fresh air inlet to open or close the fresh air inlet.

12 Claims, 6 Drawing Sheets

(51) Int. Cl.
*F24F 1/0071* (2019.01)
*F24F 13/20* (2006.01)

(58) Field of Classification Search
USPC ..... 454/237
See application file for complete search history.

(56) References Cited

U.S. PATENT DOCUMENTS

| | | | | |
|---|---|---|---|---|
| 2019/0331350 | A1* | 10/2019 | Choi | F24F 13/20 |
| 2020/0240674 | A1* | 7/2020 | Howe | F16K 1/222 |

FOREIGN PATENT DOCUMENTS

| | | | |
|---|---|---|---|
| CN | 207881069 | U | 9/2018 |
| CN | 208936280 | U | 6/2019 |
| CN | 208936412 | U | 6/2019 |
| CN | 209042560 | U | 6/2019 |
| CN | 110057014 | A | 7/2019 |
| CN | 209181105 | U | 7/2019 |
| CN | 110657492 | A | 1/2020 |
| CN | 111306638 | A | 6/2020 |
| CN | 212746709 | U | 3/2021 |
| JP | 2000008724 | A | 1/2000 |
| WO | 1997015790 | A1 | 5/1997 |

OTHER PUBLICATIONS

International Search Report and Written opinion dated Jan. 27, 2021 received in International Application No. PCT/CN2020/129247.
Supplementary European search report dated Aug. 16, 2023 received in European Patent Application No. 20929259.8.
Decision to grant dated Jun. 6, 2024 received in European Patent Application No. 20929259.8.
First Office Action dated Sep. 9, 2024 received in Chinese Patent Application No. 202010241373.3.
Examination report No. 1 dated Sep. 18, 2023 received in Australian Patent Application No. 2020440611.
Notice of acceptance dated Jan. 18, 2024 received in Australian Patent Application No. 2020440611.

* cited by examiner

WALL-MOUNTED AIR CONDITIONING INDOOR UNIT AND AIR CONDITIONER

CROSS REFERENCE TO RELATED APPLICATIONS

This application is a continuation application of PCT International Patent Application No. PCT/CN2020/129247, filed on Nov. 17, 2020, which claims priority to and benefits of Chinese Patent Application No. 202010241373.3, titled "WALL-MOUNTED AIR CONDITIONING INDOOR UNIT AND AIR CONDITIONER" and filed with the Chinese Patent Office on Mar. 30, 2020. The entire contents of the aforementioned applications are incorporated in this application by reference for all purposes. No new matter has been introduced.

FIELD

This application relates to the field of air conditioners, and in particular, to a wall-mounted air conditioning indoor unit and an air conditioner.

BACKGROUND

The current air conditioner only circularly heats or cools the indoor air when heating or cooling, and meanwhile, in order to maintain the indoor temperature, the user will close the door of the room at the same time, which will gradually deteriorate the indoor air quality and do harm to the user's health. In particular, in recent years, the air pollution is getting worse and worse, especially in the period of supplying heating in winter, and people are reluctant to open windows for ventilation. As such, the indoor air quality will deteriorate, and the level of oxygen contents in the indoor air will decrease, which harms the health of users. In the related technology, the fresh air device has been introduced into the air conditioning indoor unit. Since the fresh air inlet is kept open, the outdoor cold air will directly enter the fresh air device in cold seasons, resulting in the internal structures of the fresh air device being frozen due to long-term exposure to cold air, and the reduction of the service life of the fresh air device.

SUMMARY

An object of this application is to provide a wall-mounted air conditioning indoor unit, which aims at solving at least the technical problem of how to prolong the service life of fresh air module.

In order to achieve at least above object, this application provides a wall-mounted air conditioning indoor unit, which includes:

an indoor unit body;

a fresh air module including a housing, where the housing is provided with a fresh air inlet, a fresh air outlet, and a fresh air duct communicating the fresh air inlet with the fresh air outlet, the fresh air inlet is configured to communicate with an outdoor environment, and the fresh air outlet is configured to communicate with an air inlet of the indoor unit body;

a wind wheel installed in the fresh air duct; and a valve installed at the fresh air inlet to open or close the fresh air inlet.

In an embodiment, the valve is rotatably installed at the fresh air inlet.

In an embodiment, the valve includes a wind deflector and a first rotation shaft connected to a side of the wind deflector, and the wind deflector is rotatably connected with the housing through the first rotation shaft.

In an embodiment, the fresh air module further includes a driving device installed outside the housing, and a driving shaft of the driving device is passed through the housing and connected with the first rotation shaft to drive the first rotation shaft to rotate.

In an embodiment, the valve further includes a second rotation shaft, the first rotation shaft and the second rotation shaft are respectively connected to opposite sides of a periphery of the wind deflector, and the wind deflector is further rotatably connected with the housing through the second rotation shaft.

In an embodiment, the fresh air module further includes a limiting rib extending along a circumferential direction of the air inlet, two ends of the limiting rib are adjacent to the first rotation shaft and the second rotation shaft respectively, an inner peripheral wall of the limiting rib is protruded beyond a hole edge of the fresh air inlet, and a first surface of the wind deflector is abutted against the limiting rib at a position where the wind deflector closes the air inlet.

In an embodiment, the hole edge of the fresh air inlet is provided with a limiting groove extending along the circumferential direction, the limiting groove and the limiting rib are respectively located on both sides of the first rotation shaft, and a second surface of the wind deflector is abutted against the limiting groove at the position where the wind deflector closes the air inlet.

In an embodiment, the housing is formed with a shaft groove, a notch of the shaft groove is provided with a limiting buckle, and the second rotation shaft is rotatably engaged with the shaft groove and limited in the shaft groove by the limiting buckle.

In an embodiment, the housing includes a bottom case and a cover arranged at and configured to cover an opening of the bottom case, the fresh air inlet and the shaft groove are formed in the bottom case, an end of the second rotation shaft is protruded beyond the shaft groove and sleeved with a shaft sleeve, and the cover is provided with an accommodating groove fitted with the shaft sleeve.

In an embodiment, a periphery of the valve is provided with a sealing layer; and/or a surface of the valve is provided with a thermal insulating layer.

In an embodiment, the fresh air module further includes a purification assembly, and the purification assembly is arranged in the fresh air duct and located at an end of the wind wheel in an axial direction to correspond to an air inlet end of the wind wheel.

In an embodiment, a front side wall of the housing is provided with the fresh air outlet, and a side of the fresh air outlet is provided with an installation port from which the purification assembly is installed on the housing in a drawable manner.

In an embodiment, the purification assembly divides the fresh air duct into an air inlet cavity communicated with the fresh air inlet, and an air outlet cavity communicated with the fresh air outlet, and the wind wheel is installed in the air outlet cavity.

In an embodiment, the housing includes a bottom case and a cover arranged at and configured to cover an opening of the bottom case, the bottom case is formed with a first cavity and a second cavity which are separated from each other, the first cavity forms the air outlet cavity, the second cavity is located at a peripheral side of the first wind wheel, and the fresh air inlet is provided in a cavity wall of the second cavity; and the purification assembly is arranged at an opening of the first cavity to form a third cavity with the cover, and the third cavity is communicated with the second cavity to form the air inlet cavity.

This application further provides an air conditioner including a wall-mounted air conditioning indoor unit, the wall-mounted air conditioning indoor unit including: an indoor unit body; a fresh air module including a housing, the housing being provided with a fresh air inlet, a fresh air outlet, and a fresh air duct communicating the fresh air inlet with the fresh air outlet, the fresh air inlet being configured to communicated with the outdoor environment, and the fresh air outlet being communicated with an air inlet of the indoor unit body; and a valve installed at the fresh air inlet to open or close the fresh air inlet.

The wall-mounted air conditioning indoor unit in this application is provided with a valve at the fresh air inlet of the fresh air module to control the opening and closing of the fresh air inlet by controlling the valve, so that the fresh air inlet is prevented from being communicated with the outdoor environment for a long time, and the internal structures of the fresh air module are prevented from being exposed to cold air for a long time, especially in cold season, thus preventing the fresh air module from being frozen and prolonging the service life of the fresh air module.

BRIEF DESCRIPTION OF THE DRAWINGS

In order to describe technical solutions in the embodiments of this application or in the related art more clearly, accompanying drawings to be used in the description of the embodiments or the related art will be introduced briefly below. Obviously, the accompanying drawings to be described below are merely some embodiments of this application, and a person of ordinary skill in the art may obtain other drawings according to the structures shown in these drawings without any inventive step.

Figure 1:
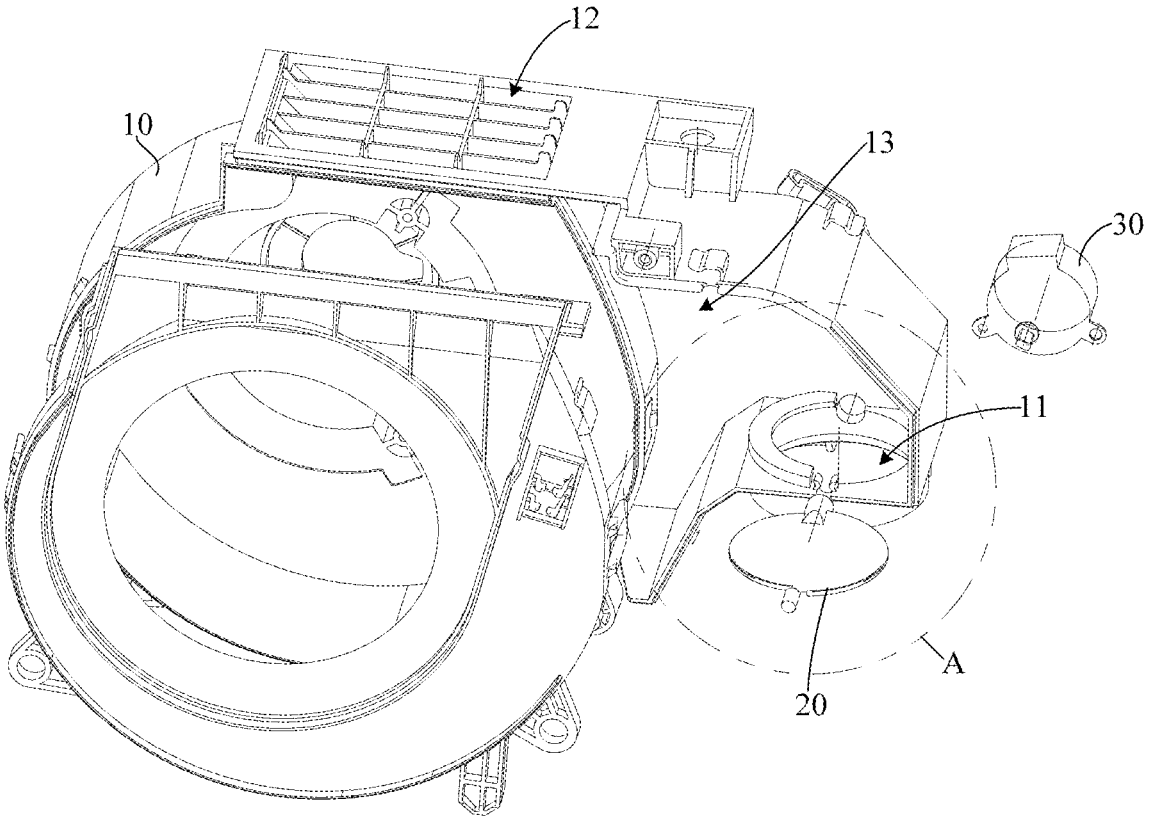
FIG. 1 is a schematic structural view of a fresh air module according to an embodiment of this application.

List of reference numerals appearing in the figures are described in the following table.

| reference sign | name | reference sign | name | reference sign | name |
|---|---|---|---|---|---|
| 10 | housing | 11 | fresh air inlet | 12 | fresh air outlet |
| 13 | fresh air duct | 20 | valve | 21 | wind |

-continued

| reference sign | name | reference sign | name | reference sign | name |
|---|---|---|---|---|---|
| 22 | first rotation shaft | 30 | driving device | 23 | deflector second rotation shaft |
| 40 | limiting rib | 15 | shaft groove | 50 | limiting buckle |
| 16 | bottom case | 17 | cover | 60 | purification assembly |
| 131 | air inlet cavity | 132 | air outlet cavity | 161 | first cavity |
| 162 | second cavity | 171 | third cavity | 70 | indoor unit body |
| 71 | casing | 711 | air inlet | 712 | first air outlet |
| 713 | second air outlet | 72 | chassis | 73 | face frame |
| 74 | panel | 80 | wind wheel | | |

The achievement of objects, functional characteristics and advantages of this application will be further explained with reference to the accompanying drawings in combination with the embodiments.

DETAILED DESCRIPTION OF EMBODIMENTS

The technical solutions in the embodiments of this application will be clearly and completely described below with reference to the accompanying drawings in the embodiments of this application. Obviously, the described embodiments are only part of the embodiments of this application, rather than all the embodiments. Based on the embodiments in this application, all other embodiments obtained by those of ordinary skill in the art without inventive step are within the protection scope of this application.

It should be noted that the various embodiments may be combined with each other, but the combination should be based on the realization by those of ordinary skill in the art. When the combination of embodiments is contradictory or cannot be implemented, it should be considered that such combination neither exists nor falls within the protection scope of this application.

The application provides a wall-mounted air conditioning indoor unit, according to an aspect of the application.

In an embodiment of this application, as shown in FIGS. 1 to 8, the wall-mounted air conditioning indoor unit includes:

an indoor unit body 70;

a fresh air module including a housing 10 provided with a fresh air inlet 11, a fresh air outlet 12, and a fresh air duct 13 communicating the fresh air inlet 11 with the fresh air outlet 12, the fresh air inlet 11 being configured to communicated with an outdoor environment, and the fresh air outlet 12 being communicated with an air inlet 711 of the indoor unit body 70;

a wind wheel 80 installed in the fresh air duct 13; and a valve 20 installed at the fresh air inlet 11 to open or close the fresh air inlet 11.

In this embodiment, the indoor unit body 70 has an air inlet 711, a first air outlet 712 and a heat exchange duct communicating the air inlet 711 with the first air outlet 712. The fresh air module may be installed at an end of the indoor unit body 70. The fresh air inlet 11 may be provided at the back of the housing 10, and the fresh air outlet 12 may be provided at the front of the housing 10, so that the rear side of the housing 10 may input air and the front side of the housing may output air. An air inlet side of the wind wheel 80 communicates with the fresh air inlet 11, and an air outlet side of the wind wheel 80 communicates with the fresh air outlet 12. When the fresh air module is in operation, the wind wheel 80 is turned on and drives fresh air to enter the fresh air duct 13 from the fresh air inlet 11. This part of fresh air first enters the wind wheel 80, and is subsequently expelled out to the fresh air outlet 12 in a radial direction of the wind wheel 80, and finally blows out from the fresh air outlet 12.

The valve 20 is movably installed at the fresh air inlet 11 to control the opening and closing of the fresh air inlet 11. The valve 20 may be moved or rotated, which is not limited here. The operation of the valve 20 may be manual or automatic, which is not limited herein. When the fresh air module is in operation, the valve 20 opens the fresh air inlet 11 to introduce outdoor fresh air into the room through the fresh air duct 13. When the fresh air module is idle, especially when the fresh air module is used less in winter, the valve 20 closes the fresh air inlet 11 to block the cold air from entering the fresh air duct 13, thus preventing the internal structures of the fresh air module from being frozen and prolonging the service life of the fresh air module.

It should be noted that all directional indications in the embodiments of this application, such as up, down, left, right, front and back, are only used to explain the relative positional relationship, movement situation or the like among various components in a certain posture as shown in the accompanying drawings. If the specific posture changes, the directional indications will also change accordingly.

The wall-mounted air conditioning indoor unit in this application is provided with a valve 20 at the fresh air inlet 11 of the fresh air module to control the opening and closing of the fresh air inlet 11 by controlling the valve 20, so that the fresh air inlet 11 may be prevented from being communicated with the outdoor environment for a long time, and especially the internal structures of the fresh air module may be prevented from being exposed to cold air in cold season for a long time, thus preventing the fresh air module from being frozen and prolonging the service life of the fresh air module.

Figure 2:
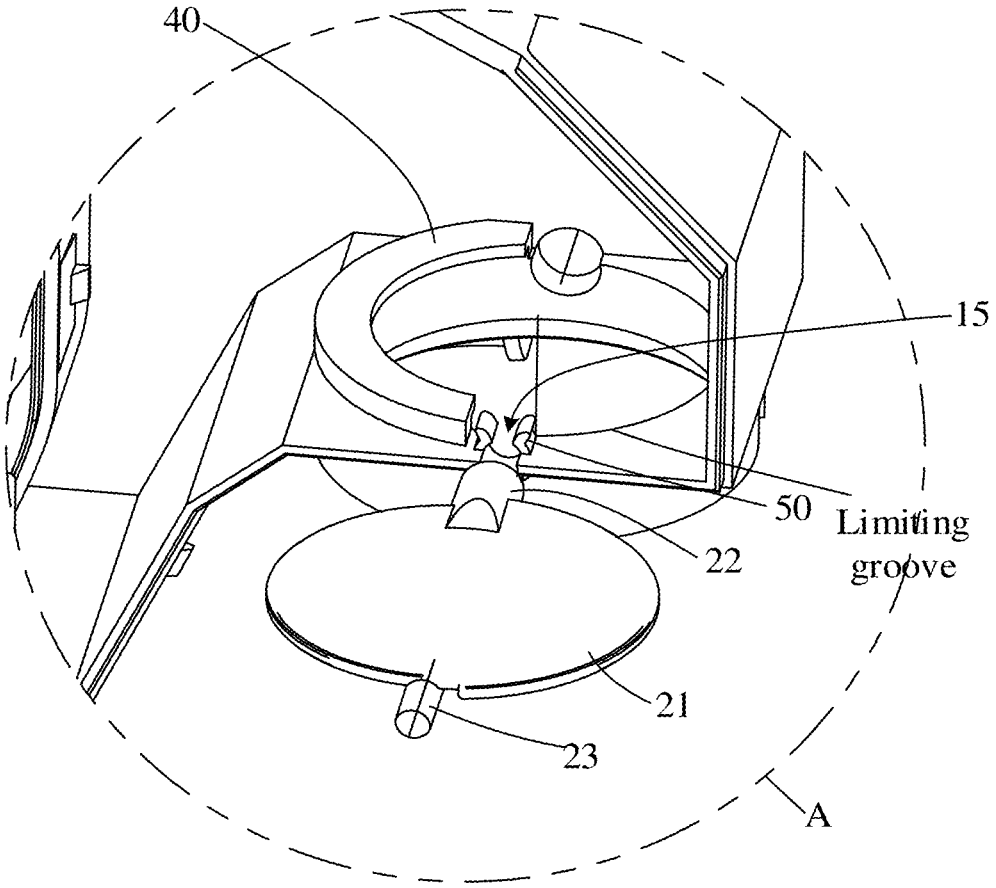
FIG. 2 is an enlarged view of portion A in FIG. 1.

In an embodiment, the valve 20 is rotatably installed at the fresh air inlet 11, and a rotation axis of the valve 20 is extended along a length direction or a width direction of the valve 20. The fresh air inlet 11 may be opened or closed by rotating, which may reduce the operating range of the valve 20, reduce the space required for the operation, and stabilize the operation of the valve 20. As shown in FIGS. 1 and 2, the valve 20 includes a wind deflector 21 and a first rotation shaft 22 connected to a side of the wind deflector 21, and the wind deflector 21 is rotatably connected with the housing 10 through the first rotation shaft 22. In this embodiment, the fresh air inlet 11 is in a shape of a circular hole, and the wind deflector 21 is in a shape of a circular plate. The first rotation shaft 22 is extended along a radial direction of the wind deflector 21 and connected to an edge of the wind deflector 21. A shaft hole is defined on a hole wall of the fresh air inlet 11, and the first rotation shaft 22 is engaged with the shaft hole to achieve the rotary connection between the wind deflector 21 and the housing 10.

Figure 7:
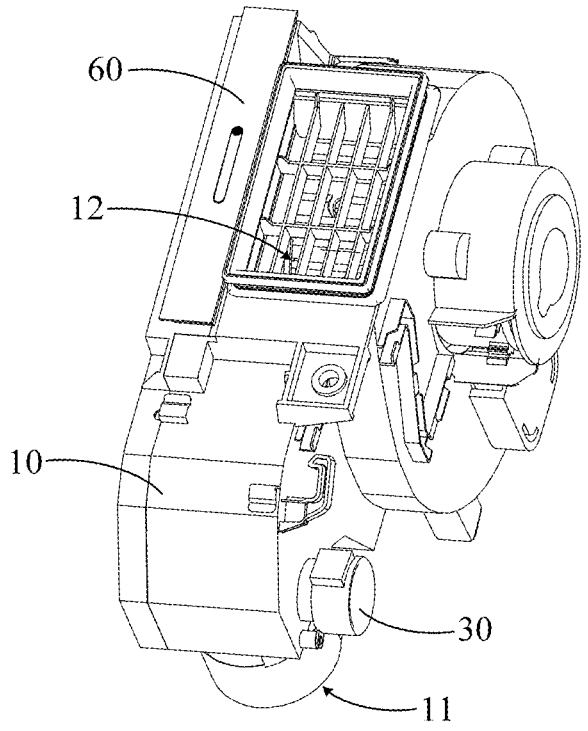
FIG. 7 is a schematic structural view of the fresh air module according to another embodiment of this application.
Figure 8:
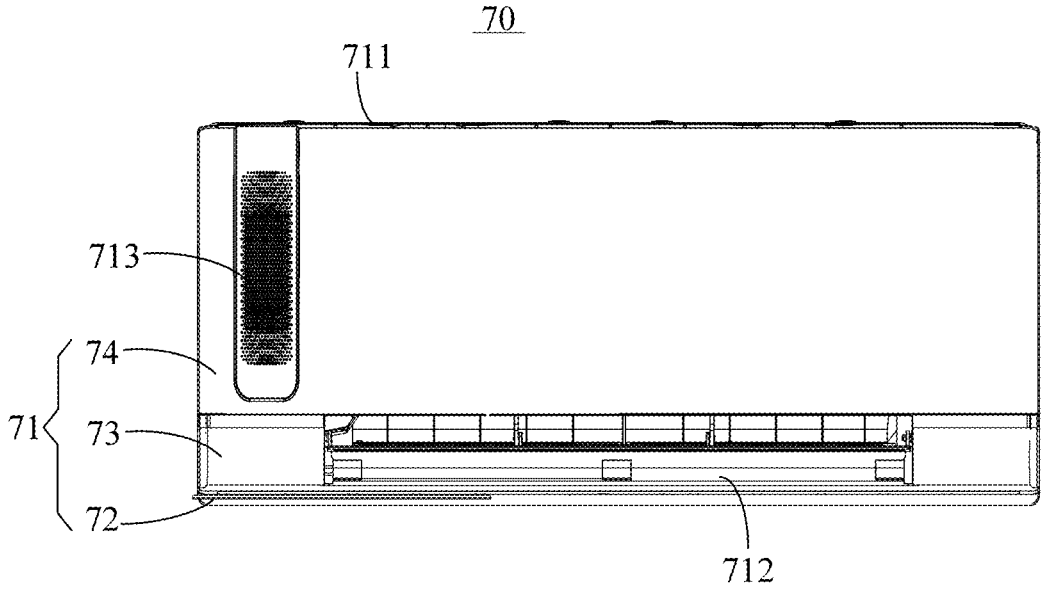
FIG. 8 is a schematic structural view of an indoor unit body according to an embodiment of this application.

In practical applications, as shown in FIGS. 1, 2 and 7, the fresh air module further includes a driving device 30 installed outside the housing 10, and a driving shaft of the driving device 30 passes through the housing 10 and is connected with the first rotation shaft 22 to drive the first rotation shaft 22 to rotate. In this embodiment, the driving device 30 may be a motor, and the driving shaft of the driving device 30 is connected with the first rotation shaft 22 through the shaft hole, thereby realizing the automatic rotation of the first rotation shaft 22. The driving device 30 is installed outside the housing 10, and can be connected to the housing 10 through a fixing member, so as to reduce the occupation of the internal space of the housing 10, and increase the air intake volume of the fresh air duct 13.

In an embodiment, as shown in FIGS. 1 and 2, the valve 20 further includes a second rotation shaft 23, the first rotation shaft 22 and the second rotation shaft 23 are respectively connected to opposite sides of the periphery of the wind deflector 21, and the wind deflector 21 is further rotatably connected with the housing 10 through the second rotation shaft 23. In this embodiment, the first rotation shaft 22 and the second rotation shaft 23 jointly support the rotation of the wind deflector 21 to share the acting force and prolong the service life.

As shown in FIG. 2, the housing 10 is formed with a shaft groove 15, a notch of the shaft groove 15 is provided with a limiting buckle 50, and the second rotation shaft 23 is rotatably engaged with the shaft groove 15 and is limited in the shaft groove 15 by the limiting buckle 50. In this embodiment, the hole edge of the fresh air inlet 11 is extended outward to form a cylindrical shape, and the shaft groove 15 is formed on an inner end face of the cylindrical shape, the notch of the shaft groove 15 faces away from an opening direction of the fresh air inlet 11, and two opposite groove walls of the shaft groove 15 are communicated with the notch. The notch of the shaft groove 15 is provided with a limiting buckle 50, which is an elastic buckle. When the valve 20 is installed, the first rotation shaft 22 is inserted into the first shaft hole, and then the second rotation shaft 23 is pressed against the limiting buckle 50 to deform the limiting buckle 50 to the avoidance notch. Thus, the second rotation shaft 23 may be engaged with the shaft groove 15, and the limiting buckle 50 is then restored to an original state to limit the second rotation shaft 23. Therefore, the installation of the valve 20 is simpler and more convenient, and the detachable installation of the valve 20 is achieved, so that the valve 20 may be serviced and replaced.

Figure 5:
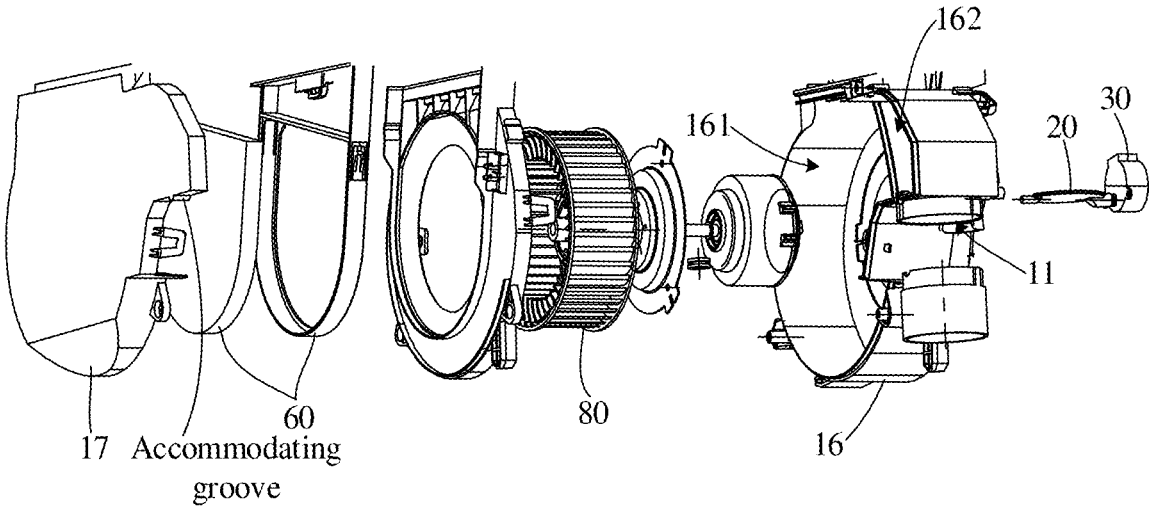
FIG. 5 is an exploded schematic view of the fresh air module according to an embodiment of this application.
Figure 6:
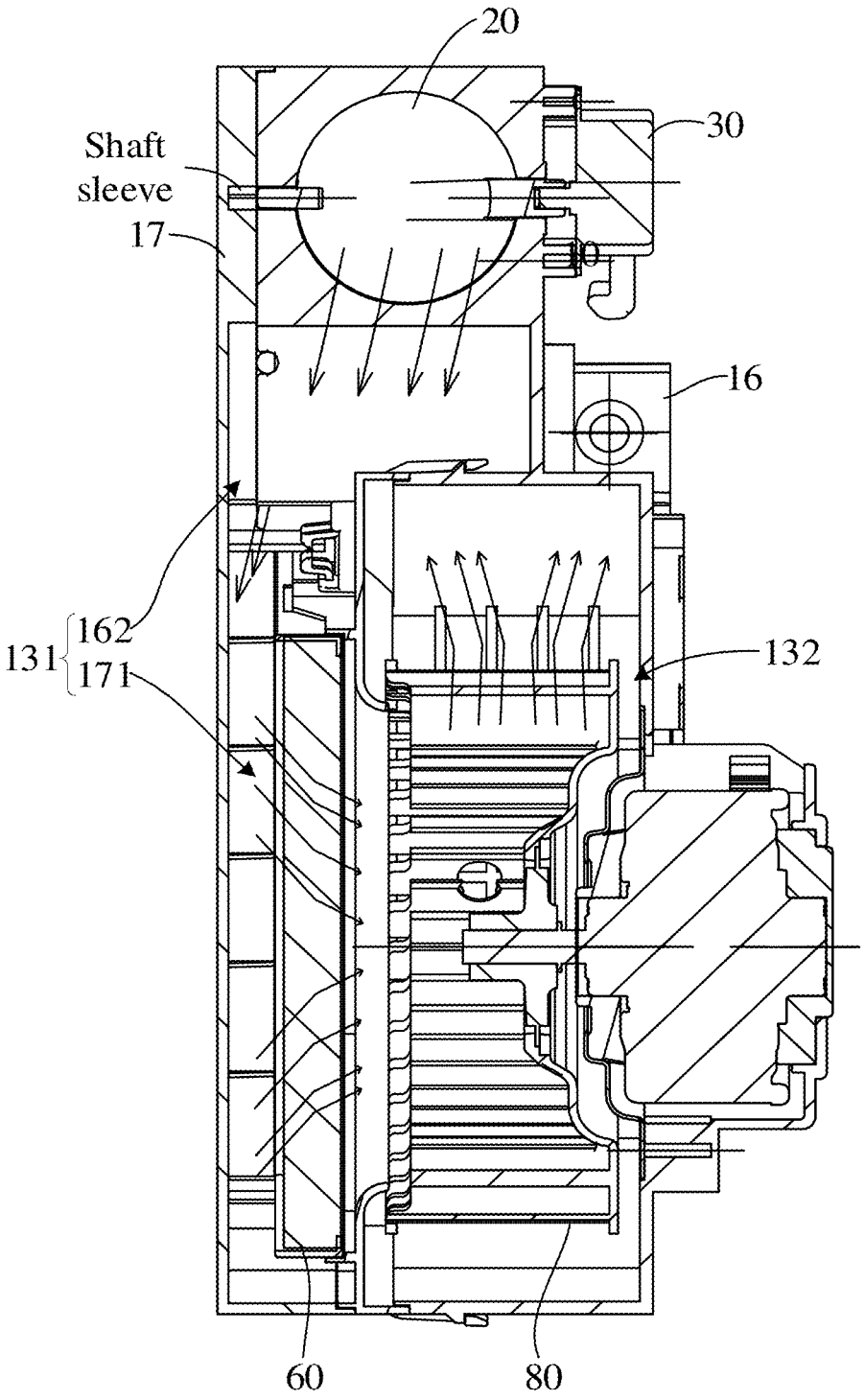
FIG. 6 is a schematic cross-sectional view of the fresh air module according to another embodiment of this application.

In practical applications, as shown in FIGS. 5 and 6, the housing 10 includes a bottom case 16 and a cover 17 arranged at and configured to cover an opening of the bottom case 16. The fresh air inlet 11 and the shaft groove 15 are formed in the bottom case 16. An end of the second rotation shaft 23 is protruded from the shaft groove 15 and sleeved with a shaft sleeve, and the cover 17 is provided with an accommodating groove fitted with the shaft sleeve. In this embodiment, the opening direction of the bottom case 16 is staggered from the opening direction of the fresh air inlet 11 and perpendicular to the opening direction of the fresh air inlet 11, that is, the opening direction of the bottom case 16 coincides with an extension direction of the second rotation shaft 23. The end of the second rotation shaft 23 protrudes beyond the shaft groove 15 and also beyond the opening of the bottom case 16. The shaft sleeve is rotatably matched with the second rotation shaft 23 to reduce the friction between the second rotation shaft 23 and a bearing, thereby reducing the wear of the second rotation shaft 23 and the shaft groove 15. The cover 17 is provided with an accommodating groove at a position corresponding to the shaft groove 15, and the shaft sleeve is fixedly engaged with the accommodating groove to achieve the rotational connection between the valve 20 and the cover 17, thereby improving the overall assembly strength of the valve 20 and the housing 10.

Figure 3:
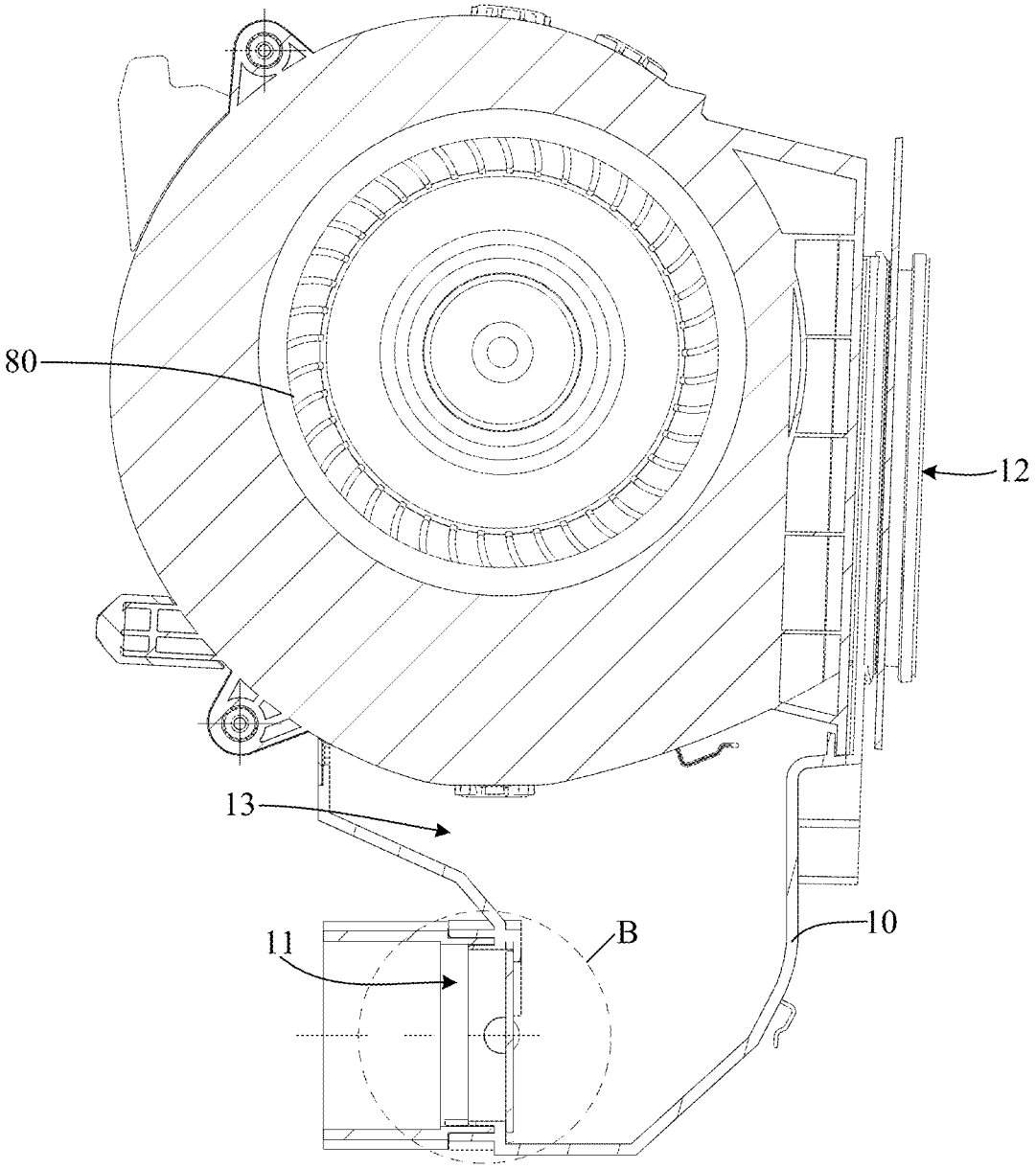
FIG. 3 is a schematic cross-sectional view of the fresh air module according to an embodiment of this application.
Figure 4:
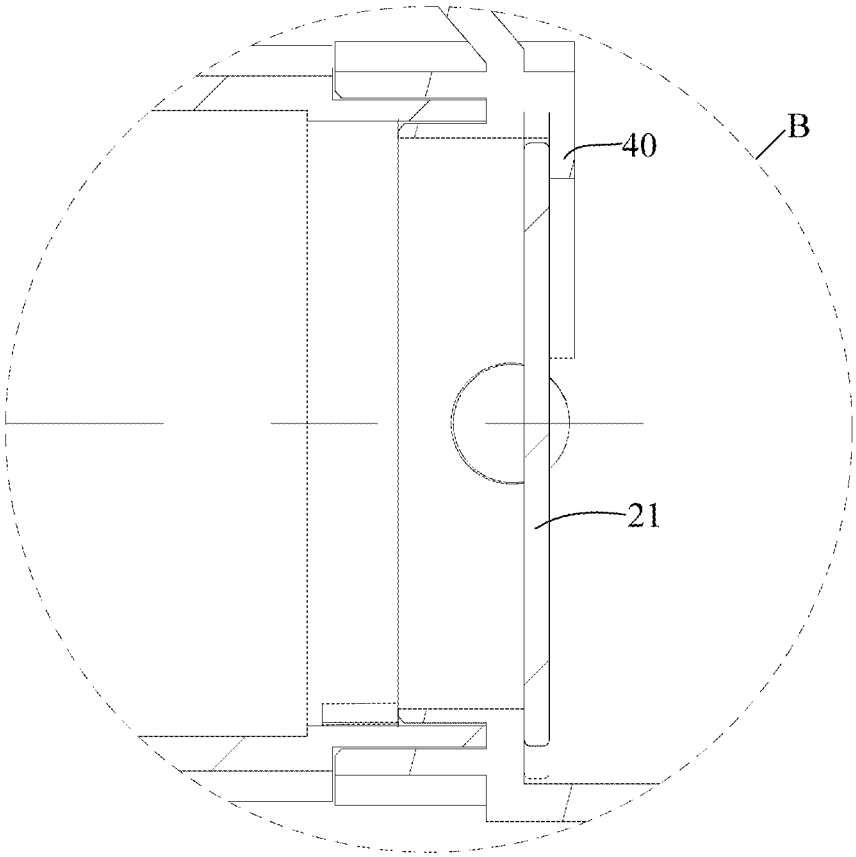
FIG. 4 is an enlarged view of portion B in FIG. 3.

In an embodiment, as shown in FIGS. 2 to 4, the fresh air module further includes a limiting rib 40 extending along a circumferential direction of the air inlet 711. Two ends of the limiting rib 40 are adjacent to the first rotation shaft 22 and the second rotation shaft 23 respectively. An inner peripheral wall of the limiting rib 40 protrudes beyond the hole edge of the fresh air inlet 11, and a first surface of the wind deflector 21 abuts against the limiting rib 40 at a position where the wind deflector 21 closes the air inlet 711. In this embodiment, the limiting rib 40 is protruded on the inner wall surface of the housing 10, the limiting rib 40 is in a semi-circular arc shape, and the inner peripheral wall of the limiting rib 40 protrudes beyond the hole edge of the fresh air inlet 11. When the wind deflector 21 is rotated to close the fresh air inlet 11, half of the periphery of the inner surface of the wind deflector 21 abuts against the limiting rib 40. The limiting rib 40 may effectively block some gaps between the wind deflector 21 and the hole edge of the fresh air inlet 11 while limiting and stopping the wind deflector 21, so as to improve the sealing performance of the wind deflector 21 closing the fresh air inlet 11.

As shown in FIGS. 2 to 4, the hole edge of the fresh air inlet 11 is provided with a limiting groove extending along the circumferential direction, the limiting groove and the limiting rib 40 are respectively located on both sides of the first rotation shaft 22, and a second surface of the wind deflector 21 abuts against the limiting groove at a position where the wind deflector 21 closes the air inlet 711. In this embodiment, the limiting groove is formed in the inner wall surface of the housing 10, and the limiting groove is in a semi-circular arc shape. When the wind deflector 21 closes the fresh air inlet 11, half of the periphery of the outer surface of the wind deflector 21 abuts against the limiting groove, so as to improve the sealing performance of the wind deflector 21 closing the fresh air inlet 11. Combined with the limiting abutment between the wind deflector 21 and the limiting rib 40, the limiting rib 40 and the limiting groove achieve the staggered sealing performance of the wind deflector 21 closing the fresh air inlet 11, and further improve the sealing performance of the wind deflector 21 closing the fresh air inlet 11. It should be appreciated that the limiting rib 40 and the limiting groove define the rotation track of the wind deflector 21, that is, the wind deflector 21 can only rotate back and forth.

In practical applications, a periphery of the valve 20 is provided with a sealing layer; and/or a surface of the valve 20 is provided with a thermal insulating layer. In this embodiment, the sealing layer may be made of an elastic material, such as plastic, so as to reduce the wear of the sealing layer caused by the operation of the valve 20 while improving the sealing performance of the valve 20, thereby improving the sealing life. The thermal insulating layer may be a coating, a cotton layer or a flocking layer, and may be arranged on the outer surface of the valve 20 to reduce the contact between cold air and the valve 20 and prevent the valve 20 from being damaged by freezing.

It should be noted that the meaning of "and/or" recited in the full text is to include three solutions, taking "A and/or B" as an example, it includes solution "A", solution "B", or both solutions "A and B".

In an embodiment, as shown in FIGS. 5 and 6, the fresh air module further includes a purification assembly 60, and the purification assembly 60 is arranged in the fresh air duct 13 and located at an end of the wind wheel 80 in an axial direction to correspond to an air inlet end of the wind wheel 80.

In this embodiment, the purification assembly 60 may filter and purify the air entering the fresh air duct 13 to improve the cleanliness of the air entering the room. The wind wheel 80 inputs air in the axial direction and outputs air in the radial direction. Compared with the narrow air inlet surface at and near the fresh air inlet 11, a larger air inlet surface is formed at the air inlet end of the wind wheel 80, so that the air inlet space formed thereby is also larger. Therefore, the purification assembly 60 is configured to correspond to the air inlet end of the wind wheel 80, so that a purification surface of the purification assembly 60 (which is provided for the air to pass through and be purified) can be correspondingly set to be larger, and the purification efficiency of the purification assembly 60 to purify the air is improved. Further, since the purification assembly 60 is designed to be larger, the air volume that may be purified by the purification assembly 60 is correspondingly increased, the service life of the purification assembly 60 is accordingly prolonged and it takes a longer period before a new purification assembly 60 is needed.

As shown in FIGS. 5 to 7, a front side wall of the housing 10 is provided with the fresh air outlet 12, and a side of the fresh air outlet 12 is provided with an installation port from which the purification assembly 60 is installed on the housing 10 in a drawable manner. In this embodiment, the purification assembly 60 includes a mounting frame and a purification member mounted on the mounting frame. The purification member may be used to remove any one or more of air pollutants such as dust, fine particles, microorganisms, and organic volatile gases (e.g., formaldehyde) in the air. The specific type of the purification member may be selected according to its function. The purification member may be any one or two of an ordinary filter screen, an HEPA screen, a formaldehyde remover or an IFD filter, and the purification member may also be any one or more of a primary-efficiency filter, a medium-efficiency filter and a high-efficiency filter.

The installation port is configured in an elongated strip shape and extends in the same direction as a side of the fresh air outlet. The purification assembly 60 is installed in the fresh air duct 13 in a drawable manner from the installation port, so that the purification assembly 60 may have an operation state of being installed in the fresh air duct 13 and an idle state of being pulled out from the installation port. In the operation state of the purification assembly 60, the purification assembly can purify the airflow of the fresh air duct 13 and remove pollutants from the air. When the purification assembly 60 is in the idle state, the user may clean or replace the purification assembly 60. The user may switch the states of the purification assembly 60 by pulling the purification assembly 60 by hand. In addition, the fresh air outlet 12 of the fresh air module usually faces an area where the user is located. The installation port of the drawable purification assembly 60 is provided at a side of the fresh air outlet 12 (that is, the installation port faces the area where the user is located), so that it is convenient for the user to draw the purification assembly 60 from the front side to switch the states of the purification assembly 60.

In an embodiment, as shown in FIGS. 5 and 6, the purification assembly 60 divides the fresh air duct 13 into an air inlet cavity 131 communicated with the fresh air inlet 11, and an air outlet cavity 132 communicated with the fresh air outlet 12, and the wind wheel 80 is installed in the air outlet cavity 132. In this embodiment, the wind wheel 80 is a centrifugal wind wheel 80, an air inlet side of the wind wheel 80 corresponds to the purification assembly 60, and an end of the wind wheel 80 facing away from the air inlet side is connected with a driving motor to drive the wind wheel 80 to rotate. The air enters the air inlet cavity 131 from the fresh air inlet 11, is purified by the purification assembly 60 to be clean fresh air, then enters the inside of the wind wheel 80, and finally is blown out by the centrifugal wind wheel 80 toward the fresh air outlet 12.

As shown in FIGS. 5 and 6, the housing 10 includes a bottom case 16 and a cover 17 arranged at and configured to cover an opening of the bottom case 16, the bottom case 16 is formed with a first cavity 161 and a second cavity 162 which are separated from each other, the first cavity 161 forms the air outlet cavity 132, the second cavity 162 is located at a peripheral side of the wind wheel 80, and the fresh air inlet 11 is provided in a cavity wall of the second cavity 162. The purification assembly 60 is arranged at an opening of the first cavity 161 to form a third cavity 171 with the cover 17, and the third cavity 171 is communicated with the second cavity 162 to form the air inlet cavity 131.

In this embodiment, after the fresh air enters the first cavity 161 from the fresh air inlet 11, it first flows to the third cavity 171, passes through the purification assembly 60 and then flows to the third cavity 171, and finally blows out from the fresh air outlet 12. In this way, both the fresh air inlet 11 and the fresh air outlet 12 may be located at the peripheral side of the wind wheel 80, thus simplifying the external shape of the housing 10 and reducing the occupied space, so as to facilitate the assembly of the fresh air module and the indoor unit body 70.

It should be noted that if there are descriptions such as "first" and "second" in the embodiments of this application, the descriptions such as "first" and "second" in this application are only used for descriptive purposes, and should not be understood as indicating or implying their relative importance or implicitly indicating the number of indicated technical features. Therefore, the features defined with "first" and "second" may include at least one of these features explicitly or implicitly.

In practical applications, the casing 71 includes a chassis 72, a frame 73 and a panel 74. The fresh air module is installed at the end of the chassis 72, and the fresh air outlet 12 of the fresh air module has an opening facing the panel 74. Accordingly, the panel 74 is provided with a second air outlet 713 at a position corresponding to the fresh air outlet 12, so that the indoor unit body 70 may send fresh air forward, and the fresh air may accurately reach the position where the user is located. In addition, in order to avoid fresh air being blown directly to the user, optionally, the second air outlet 713 may be composed of a plurality of micro-pores penetrating through the panel 74, so that the airflow is broken into strands of smaller filament airflow after the fresh air is blown out from the plurality of micro-pores, the wind speed is reduced, and the airflow becomes soft and will not be blown directly to the user, thus avoiding to cause discomfort to the user.

The present application also provides an air conditioner, which includes a wall-mounted air conditioning indoor unit. The specific structures of the wall-mounted air conditioning indoor unit refers to the above embodiments. As this air conditioner adopts all the technical solutions of all the above embodiments, it has at least all the beneficial effects brought by the technical solutions of the above embodiments, which will not be repeated here.

The above embodiments are only optional embodiments of this application, and do not limit the protection scope of this application. All equivalent changes made by using the contents of the specification and drawings of this application, or direct/indirect application in other related technical fields under the concept of this application are included in the protection scope of this application.

The invention claimed is:

1. A wall-mounted air conditioning indoor unit comprising:

an indoor unit body;

a fresh air module comprising a housing, wherein the housing is provided with a fresh air inlet, a fresh air outlet, and a fresh air duct communicating the fresh air inlet with the fresh air outlet, the fresh air inlet is configured to communicate with an outdoor environment, and the fresh air outlet is configured to communicate with an air inlet of the indoor unit body;

a wind wheel provided in the fresh air duct; and a valve provided at the fresh air inlet to open or close the fresh air inlet, wherein:

the valve comprises a wind deflector and a first rotation shaft connected to a side of the wind deflector, the wind deflector is rotatably connected with the housing through the first rotation shaft, the valve further comprises a second rotation shaft, the first rotation shaft and the second rotation shaft are respectively connected to opposite sides of a periphery of the wind deflector, the wind deflector is further rotatably connected with the housing through the second rotation shaft, the housing is formed with a shaft groove, the second rotation shaft is rotatably engaged with the shaft groove, the housing comprises a bottom case and a cover arranged at and configured to cover an opening of the bottom case, the fresh air inlet and the shaft groove are formed in the bottom case, an end of the second rotation shaft is protruded beyond the shaft groove and sleeved with a shaft sleeve, and the cover is provided with an accommodating groove fitted with the shaft sleeve.

2. The wall-mounted air conditioning indoor unit according to claim 1, wherein the valve is rotatably provided at the fresh air inlet.

3. The wall-mounted air conditioning indoor unit according to claim 1, wherein:

the fresh air module further comprises a driving device provided outside the housing, and a driving shaft of the driving device passes through the housing and is connected with the first rotation shaft to drive the first rotation shaft to rotate.

4. The wall-mounted air conditioning indoor unit according to claim 1, wherein:

the fresh air module further comprises a limiting rib extending along a circumferential direction of the fresh air inlet, two ends of the limiting rib are adjacent to the first rotation shaft and the second rotation shaft respectively, an inner peripheral wall of the limiting rib is protruded beyond a hole edge of the fresh air inlet, and a first surface of the wind deflector is abutted against the limiting rib at a position where the wind deflector closes the fresh air inlet.

5. The wall-mounted air conditioning indoor unit according to claim 4, wherein:

the hole edge of the fresh air inlet is provided with a limiting groove extending along the circumferential direction, the limiting groove and the limiting rib are respectively located on both sides of the first rotation shaft, and a second surface of the wind deflector is abutted against the limiting groove at the position where the wind deflector closes the fresh air inlet.

6. The wall-mounted air conditioning indoor unit according to claim 1, wherein:

a notch of the shaft groove is provided with a limiting buckle, and the second rotation shaft is limited in the shaft groove by the limiting buckle.

7. The wall-mounted air conditioning indoor unit according to claim 1, wherein:

a periphery of the valve is provided with a sealing layer, and/or a surface of the valve is provided with a thermal insulating layer.

8. The wall-mounted air conditioning indoor unit according to claim 1, wherein:

the fresh air module further comprises a purification assembly, and the purification assembly is arranged in the fresh air duct and located at an end of the wind wheel in an axial direction to correspond to an air inlet end of the wind wheel.

9. The wall-mounted air conditioning indoor unit according to claim 8, wherein:

a front side wall of the housing is provided with the fresh air outlet, and a side of the fresh air outlet is provided with an installation port, wherein the purification assembly is installed on the housing in a drawable manner from the installation port.

10. The wall-mounted air conditioning indoor unit according to claim 9, wherein:

the purification assembly divides the fresh air duct into an air inlet cavity communicated with the fresh air inlet, and an air outlet cavity communicated with the fresh air outlet, and the wind wheel is provided in the air outlet cavity.

11. The wall-mounted air conditioning indoor unit according to claim 10, wherein:

the housing comprises a bottom case and a cover arranged at and configured to cover an opening of the bottom case, the bottom case is formed with a first cavity and a second cavity which are separated from each other, the first cavity forms the air outlet cavity, the second cavity is located at a peripheral side of the wind wheel, and the fresh air inlet is provided in a cavity wall of the second cavity, and the purification assembly is arranged at an opening of the first cavity to form a third cavity with the cover, and the third cavity is communicated with the second cavity to form the air inlet cavity.

12. An air conditioner comprising a wall-mounted air conditioning indoor unit according to claim 1.

* * * * *